US008434754B2

(12) United States Patent
Li et al.

(10) Patent No.: US 8,434,754 B2
(45) Date of Patent: May 7, 2013

(54) METHOD AND SYSTEM FOR JOB SEPARATION IN HIGH VOLUME DOCUMENT SCANNING

(75) Inventors: Xing Li, Webster, NY (US); John Allott Moore, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 163 days.

(21) Appl. No.: 13/090,100

(22) Filed: Apr. 19, 2011

(65) Prior Publication Data

US 2012/0269611 A1 Oct. 25, 2012

(51) Int. Cl.
*B65H 33/04* (2006.01)

(52) U.S. Cl.
USPC ..... 270/58.31; 270/52.02

(58) Field of Classification Search ..... 270/52.03, 270/58.02, 58.31, 58.32
See application file for complete search history.

(56) References Cited

U.S. PATENT DOCUMENTS

| | | | | |
|---|---|---|---|---|
| 4,033,579 | A | 7/1977 | Stange et al. | |
| 4,166,540 | A | 9/1979 | Marshall | |
| 4,429,991 | A | 2/1984 | Williams | |
| 4,834,360 | A * | 5/1989 | Acquaviva | 271/3.04 |
| 5,334,825 | A | 8/1994 | Maddox | |
| 5,394,992 | A | 3/1995 | Winkler | |
| 5,618,035 | A | 4/1997 | Coombs et al. | |
| 5,823,529 | A * | 10/1998 | Mandel et al. | 271/296 |
| 6,227,531 | B1 * | 5/2001 | Guerrero et al. | 270/58.31 |
| 6,527,269 | B2 * | 3/2003 | Yamada et al. | 271/221 |
| 7,855,799 | B2 * | 12/2010 | Shah | 358/1.15 |
| 2012/0127540 | A1 * | 5/2012 | Moore et al. | 358/474 |

* cited by examiner

*Primary Examiner* — Leslie A Nicholson, III

(74) *Attorney, Agent, or Firm* — Pillsbury Winthrop Shaw Pittman, LLP

(57) ABSTRACT

A method for job separation in a high volume document scanning is provided. The method includes monitoring a document receiver with a monitor device to determine when a batch of documents has been received by the document receiver and in response to the monitor device determining the batch of documents has been received by the document receiver, automatically inserting a job separation document with a separation document inserter at an end of the batch to separate the batch of documents from a successive batch of documents.

12 Claims, 10 Drawing Sheets

METHOD AND SYSTEM FOR JOB SEPARATION IN HIGH VOLUME DOCUMENT SCANNING

BACKGROUND

1. Field

The present disclosure relates to a method and a system for job separation in a high volume document scanning.

2. Description of Related Art

Efficiency is an important part of any production mailroom solution. In the mailroom, documents are scanned one at a time. However, the process of scanning documents one at a time is very expensive.

In order to improve throughput, scanning is often done in large batches, where scan jobs (or batches) are typically separated by a slip-sheet with barcodes. While scanning documents in large batches does improve the throughput, it adds process time by having operator(s) insert the slip-sheets between the scan jobs and sometimes remove the slip-sheets from between the scan jobs.

Some methods of document separation do not require the use of a slip-sheet. While these methods may save the cost of slip sheets and the process time of the operator, it may introduce inconvenience in cases in which the scanned original documents need to be separated after the scanning process.

The present disclosure provides improvements over the prior art.

SUMMARY

According to one aspect of the present disclosure, a method for job separation in a high volume document scanning is provided. The method includes monitoring a document receiver with a monitor device to determine when a batch of documents has been received by the document receiver and in response to the monitor device determining the batch of documents has been received by the document receiver, automatically inserting a job separation document with a separation document inserter at an end of the batch to separate the batch of documents from a successive batch of documents.

According to another aspect of the present disclosure, a system for job separation in a high volume document scanning is provided. The system includes a monitor device and a separation document inserter. The monitor device is configured to monitor a document receiver to determine when a batch of documents has been received by the document receiver. The separation document inserter is configured to automatically insert, in response to the monitor device determining the batch of documents has been received by the document receiver, a job separation document at an end of the batch to separate the batch of documents from a successive batch of documents.

Other objects, features, and advantages of one or more embodiments of the present disclosure will seem apparent from the following detailed description, and accompanying drawings, and the appended claims.

BRIEF DESCRIPTION OF THE DRAWINGS

Various embodiments will now be disclosed, by way of example only, with reference to the accompanying schematic drawings in which corresponding reference symbols indicate corresponding parts, in which.

DETAILED DESCRIPTION

The present disclosure proposes automatically dispensing slip sheets when a new document(s) is added to the stack to be batch scanned. The proposed method does not need an operator to handle the slip sheets (e.g., to insert the slip sheets between the scan jobs). The dispensing of slip sheet may be triggered by a weighing machine that senses a weight change in the document stack, by a light sensing device that senses the placement of a new document in the scan stack, or by some other mechanism that senses the placement of a new document in the scan stack.

Figure 1:
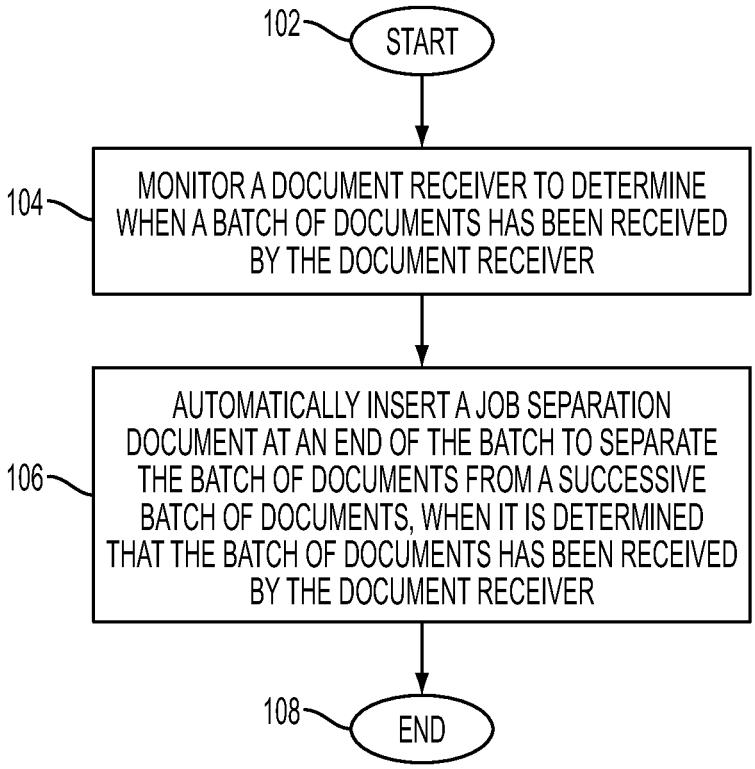
FIG. 1 illustrates a method for job separation in a high volume document scanning in accordance with an embodiment of the present disclosure.

FIG. 1 illustrates a method 100 for job separation in a high volume document scanning in accordance with an embodiment of the present disclosure. The method 100 begins at procedure 102.

At procedure 104, a monitor device 202 monitors a document receiver 204 to determine when a batch of documents 214 has been received by the document receiver 204. The monitor device 202, the document receiver 204, and batch of documents 214 are shown and explained with respect to FIGS. 2 and 3.

Figure 2:
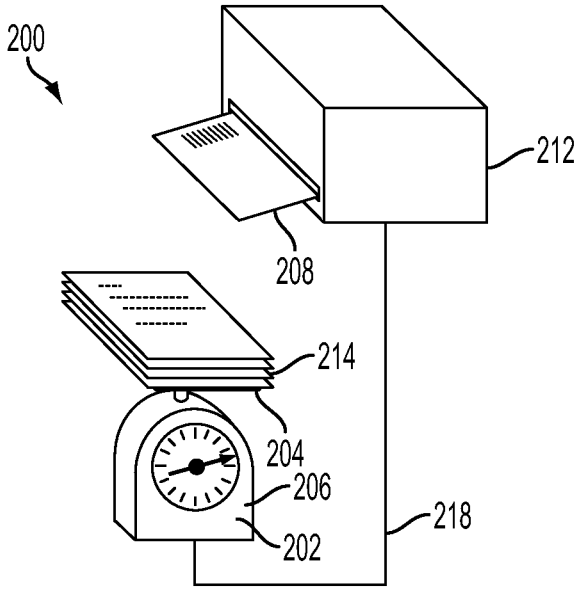
FIG. 2 illustrates a system for job separation in a high volume document scanning in accordance with an embodiment of the present disclosure.

As shown in and explained with respect to FIG. 2, the monitor device 202 may be a weighing machine 206. As shown in and explained with respect to FIG. 3, the monitor device 202 may be a light sensing device 306. It is contemplated that any other mechanism, such as, for example, a sound sensing device, a height sensing device, an electrostatic sensing device may used to determine when a new batch of documents is received by the document receiver 204.

The document receiver 204 may be in the form of a tray or a support member that is configured to receive the documents to be scanned.

Next at procedure 106, a separation document inserter 212 (as shown in and explained with respect to FIGS. 2 and 3), in response to the monitor device 202 determining that the batch of documents 214 has been received by the document receiver 204, automatically inserts a job separation document 208 at an end of the batch 214 to separate the batch of documents 214 from a successive batch of documents 210. The monitoring procedure 104 and the inserting procedure 106 are repeated for each successive batch of documents. The monitoring procedure 104 and the inserting procedure 106 are shown in and explained in detail with respect to FIGS. 4A-4D and 5A-5D.

The method 100 may optionally include, during scanning of the received documents, separating the job separation documents 208 from the received documents 210 and 214 (See FIGS. 4A-C and 5A-C) and placing the separated job separation documents 208 into a job separation document receiver (not shown) for reuse during a subsequent job separation. For example, the procedure for separating the job separation documents from the scanned documents is explained in detail in U.S. Pat. Nos. 4,166,540 titled "Document Sorter Utilizing Cascaded Sorting Steps" and 5,394,992 titled "Document Sorter," which herein are incorporated by reference in their entirety.

The job separation document receiver may be in the form of a tray or a support member that is configured to receive the job separation documents and to store the job separation documents for reuse during a subsequent job separation.

Alternatively, the method 100 may optionally include, during scanning of the received documents, shifting (or offsetting) the job separation documents 208 relative to their adjacent batches of documents 210 and 214 as the job separation documents 208 and their adjacent batches of documents 210 and 214 are being placed into an output document receiver (not shown). The method 100 then includes separating shifted or offset job separation documents 208 from their adjacent batches of documents 210 and 214 after the scanning and placing the separated job separation documents into a job separation document receiver (not shown) for reuse during a subsequent job separation. For example, the procedure for shifting (or offsetting) the job separation documents with respect to the scanned documents and for separating the job separation documents from the scanned documents is explained in detail in U.S. Pat. Nos. 4,033,579 titled "Offset Stacker" and 5,618,035 titled "Offset Stacker," which herein are incorporated by reference in their entirety.

The job separation document receiver may be in the form of a tray or a support member that is configured to receive the job separation documents and to store the job separation documents for reuse during a subsequent job separation. The output document receiver may be in the form of a tray or a support member that is configured to receive and store the batches of documents 210 and 214 after the scanning process is complete.

The method 100 may optionally include examining the quality of the job separation documents 208 to determine whether the job separation documents 208 are still suitable for further reuse. The quality of the job separation documents 208 is examined using an image analysis device. The image analysis device is configured to detect noise level in the job separation documents 208 or integrity of the barcode on the job separation documents 208. For example, the procedure for examining the quality of the job separation documents using an image analysis device is explained in detail in U.S. Pat. Nos. 4,429,991 titled "Method for Detecting Physical Anomalies of U.S. Currency" and 5,334,825 titled "System And Method For Monitoring Barcode Label Quality," which herein are incorporated by reference in their entirety. The method 100 ends at procedure 108.

Figure 3:
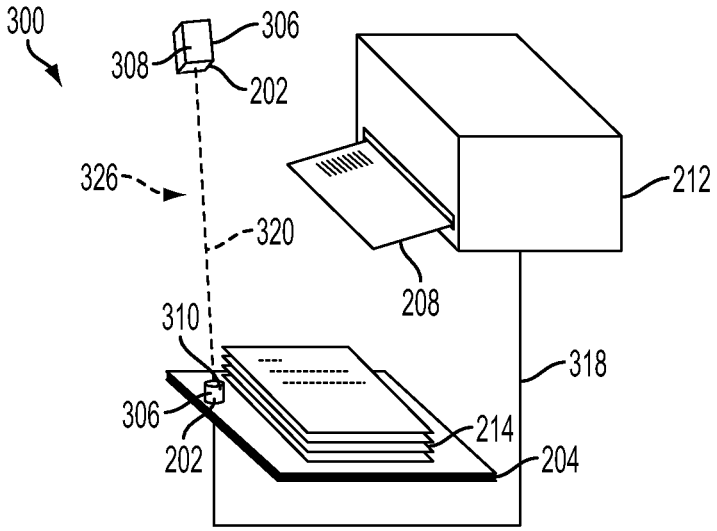
FIG. 3 illustrates a system for job separation in a high volume document scanning in accordance with another embodiment of the present disclosure.

FIG. 2 illustrates a system 200 for job separation in a high volume document scanning in accordance with an embodiment of the present disclosure. FIG. 3 illustrates a system 300 for job separation in a high volume document scanning in accordance with another embodiment of the present disclosure.

As the system of the present disclosure is capable of performing bulk document scanning and performing document separation with minimal or no interaction from the operator, the system reduces processing time to scan and separate multiple document sets.

The system 200, illustrated in FIG. 2, uses a weight change in the document stack to trigger the dispensing of slip sheet(s) while the system 300, illustrated in FIG. 3, uses a light sensing device to detect the placement of a new document in the scan stack and in response triggers slip sheet(s) dispensation.

Referring to FIGS. 2 and 3, the systems 200 and 300 each include the monitor device 202, the document receiver 204 and the separation document inserter 212. The monitor device 202 is operatively connected to the separation document inserter 212.

The monitor device 202 is configured to monitor the document receiver 204 to determine when a batch of documents has been received by the document receiver 204. The separation document inserter 212 configured to automatically insert, in response to the monitor device 202 determining the batch of documents 214 has been received by the document receiver 202, a job separation document 208 at an end of the batch 214 to separate the batch of documents 214 from a successive batch of documents 210.

The document receiver 204 may be in the form of a tray or a support member that is configured to receive the documents to be scanned.

The slip sheet may be distinguishable from the documents in the stack (to be batch scanned). The slip sheet may have a different size, different color, different thickness, etc. than documents in the stack so that the slip sheets may be easily identified (e.g., visually and/or physically). The slip sheet may include identifying information about the user or the documents that are being batch scanned. For example, the slip sheet may include specially printed words, numbers, bar codes, colors, aperture patterns, or other marking indicia.

In the system 200, the monitor device 202 is a weighing machine or a weight scale 206. The weighing machine 206 may be configured to monitor a change in weight of the received documents to detect when a new batch of documents is added to the document receiver 204. The weighing machine 206 may also be configured to monitor a change in weight of the document receiver 204 to detect when a new batch of documents is added to the document receiver 204.

The weighing machine 206 is configured to send a weight change signal 218 to the separation document inserter 212. The weight change signal 218 indicates that a new batch of documents is added to the document receiver 204. The separation document inserter 212 receives this weight change signal 218 and then automatically inserts or dispenses a job separation document 208 at an end of the batch to separate the batch of documents 214 from a successive batch of documents 210.

The system 200 may also include a data storage device that is configured to store the weight of the batch of the documents in the document receiver 204. The system 200 may optionally include a processor operatively connected to the data storage device. The processor may be configured to compare the current weight of the batch of the documents in the document receiver 204 with previously stored or saved weight of the batch of the documents in the document receiver 204 to detect a weight change. In such an embodiment, the processor may send a signal to the separation document inserter 212 to automatically insert a job separation document 208 at an end of the batch to separate the batch of documents 214 from a successive batch of documents 210, when the weight change is detected. Processor and/or data storage device may be disposed either in the weighing machine 206 or the separation document inserter 212. Alternatively, the processor and/or data storage device may be separate or stand-alone devices.

The monitor device 202, the separation document inserter 212, the document receiver 204, the processor and the data storage device may be coupled together via data communication links. These links may be any type of link that permits the transmission of data, such as direct serial connections, a local area network (LAN), wide area network (WAN), an intranet, the Internet, circuit wirings, and the like.

The separation document inserter 212 may include a print engine operatively connected to the monitor device 202. The print engine is configured to print slip sheets based on the weight change signal 218 received from the monitor device 202. Alternatively, the separation document inserter 212 may include a plurality of pre-printed slip-sheets, which are dispensed by the separation document inserter 212 when a weight change signal 218 is received from the monitor device 202.

The system 300 is similar to system 200 except for the below noted differences. The system 300 uses the light sensing device 306 (instead of the weighing machine 206) as a monitor device 202. The light sensing device 306 is configured to monitor when a new batch of documents are added to the document receiver 204.

The light sensing device 306 may include a light beam transmitter 308 and a light beam receiver (detector or sensor) 310. The light sensor device 306 may be an infra-red sensor or any other optical sensor. The light beam transmitter 308 may include Light Emitting Diodes (LEDs) or a laser light source.

In one embodiment, the light beam transmitter 308 is disposed on the document receiver 204 and its corresponding light beam receiver 310 is disposed in a spaced-apart relationship from and directly above the light beam transmitter 308. In another embodiment, the light beam receiver 310 may be disposed on the document receiver 204 and its corresponding light beam transmitter 308 disposed in a spaced-apart relationship from and directly above the light beam receiver 310. In both these arrangements, the light beam transmitter 308 and the light beam receiver 310 are arranged such that the light beam from the light beam transmitter 308 is received by the light beam receiver 310. Line 320 represents a light beam that is transmitted from the light beam transmitter 308 to the light beam receiver 310.

As a new batch of documents is being placed on the document receiver 204, the batch passes through space 326 between the light beam receiver 310 and the light beam transmitter 308. When the batch is passing through the space 326, the batch blocks or obstructs the light beam 320 from the light beam transmitter 308 to the light beam receiver 310. When the light beam 320 is obstructed or blocked for a brief period of time, the light sensing device 306 is configured to generate a signal or pulse 318. The signal 318 indicates that a new batch of documents is added to the document receiver 204. The light sensing device 306 then sends the signal or pulse 318 to the separation document inserter 212. The separation document inserter 212 receives this signal or pulse 318 and automatically inserts or dispenses a job separation document 208 at an end of the batch to separate the batch of documents from a successive batch of documents.

In another embodiment, when a new batch is passing through the space 326, the light beam receiver 310 detects a decrease or change in transmission of the light emitted by the light beam transmitter 308. The light sensing device 306 generates a signal or pulse 318, when such a change or decrease in the light transmission is detected. The signal 318 indicates that a new batch of documents is added to the document receiver 204. The light sensing device 306 then sends the signal or pulse 318 to the separation document inserter 212. In response to the received signal 318, the separation document inserter 212 automatically inserts or dispenses a job separation document 208 at an end of the batch to separate the batch of documents from a successive batch of documents.

FIGS. 4A-4D illustrate procedures of the method 100 for job separation in a high volume document scanning, when a weighing machine 206 is used as a monitor device 202, in accordance with an embodiment of the present disclosure.

Figure 4A:
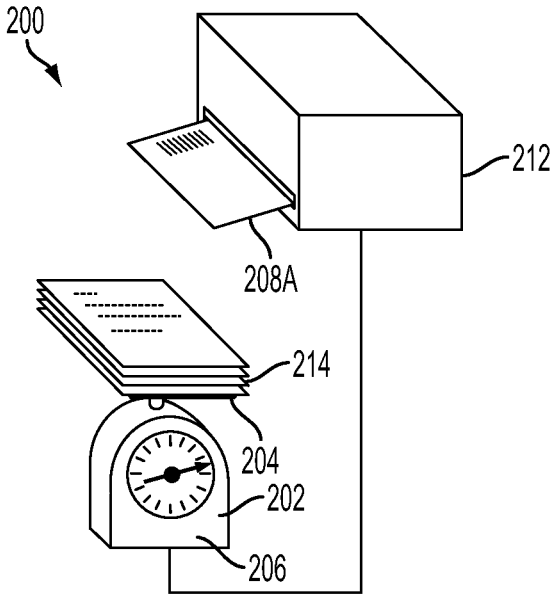
FIGS. 4A-4D illustrate procedures of the method for job separation in a high volume document scanning, when a weighing machine is used as a monitor device, in accordance with an embodiment of the present disclosure.
Figure 4B:
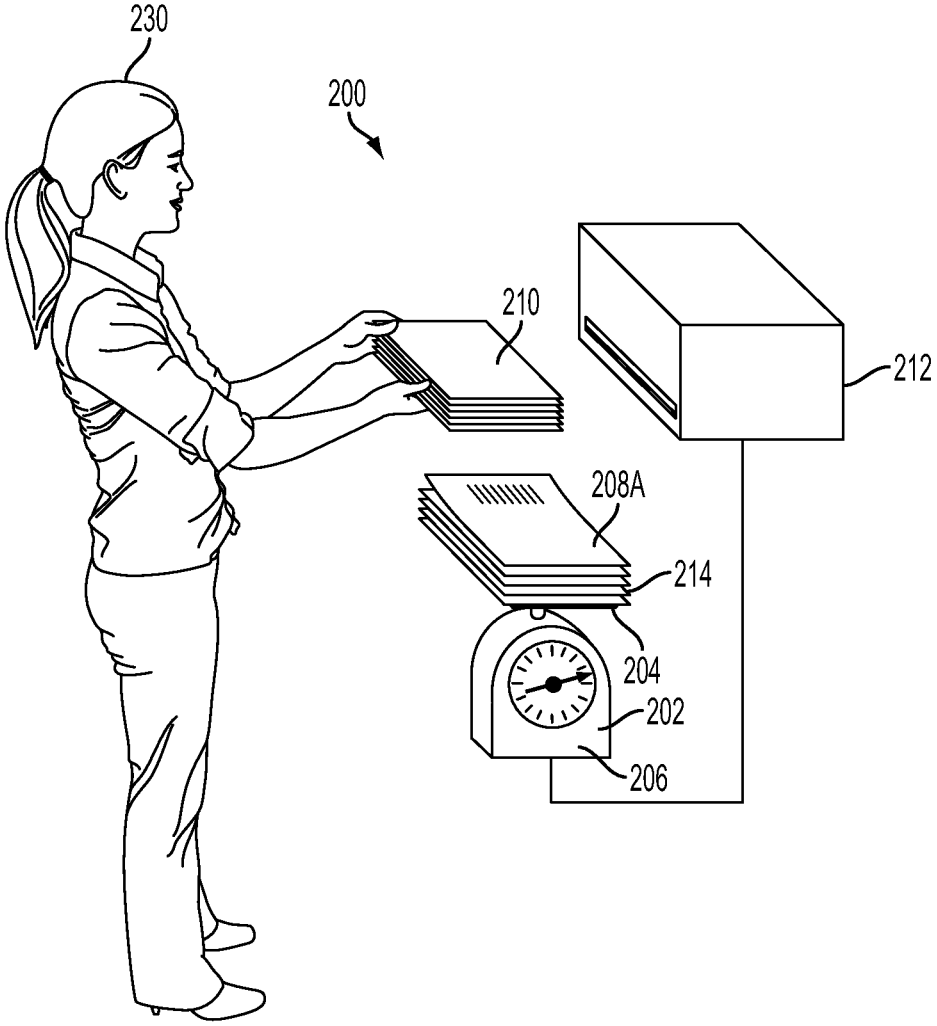

Referring to FIGS. 4A and 4B, in response to the weighing machine 206 determining that a new batch 214 of documents has been received by the document receiver 204, the separation document inserter 212 automatically inserts a job separation document 208A at an end of the batch 214 to separate the batch of documents 214 from a successive batch of documents 210. In one embodiment, the weighing machine 206 is configured to continuously monitor a change in weight of the received documents to detect when a new batch of documents 214 is added to the document receiver 204. In another embodiment, the weighing machine 206 is configured to continuously monitor a change in weight of the document receiver 204 to detect when a new batch of documents 214 is added to the document receiver 204.

After the job separation document 208A is inserted at an end of the batch 214, the weighing machine 206 continues to monitor the document receiver 204 to determine when a new batch 210 of documents has been received by the document receiver 204.

Figure 4C:
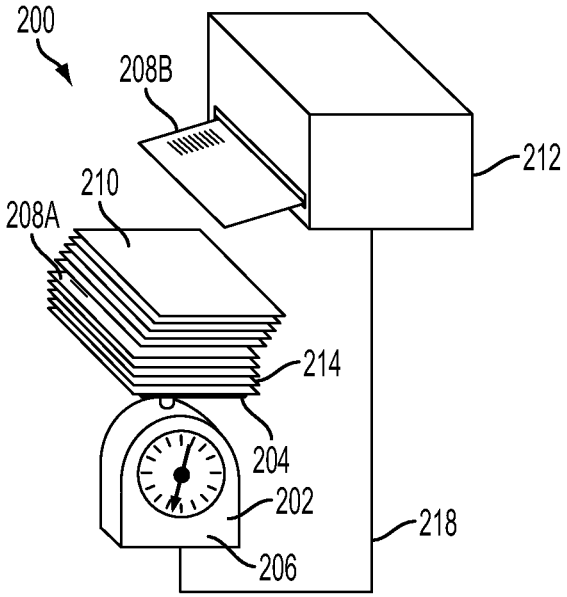
Figure 4D:
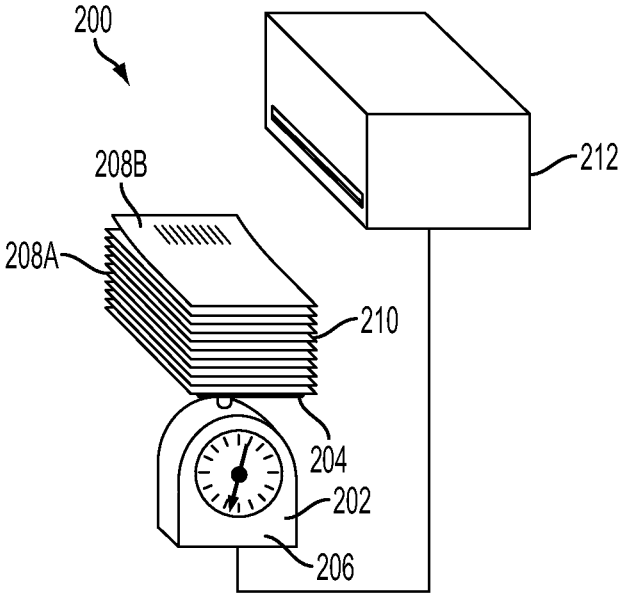

When an operator 220 adds a new batch 210 of documents to the document receiver 204, as shown in FIGS. 4B and 4C, the weighing machine 206 detects a change in weight of the documents in the document receiver 204 and determines that the batch 210 of documents is received by the document receiver 204. The weighing machine 206 then sends the signal 218 to the separation document inserter 212. The weight change signal 218 indicates that a new batch of documents is added to the document receiver 204. In response to the signal 218, as shown in FIGS. 4C and 4D, the separation document inserter 212 automatically inserts a job separation document 208B at an end of the batch 210 to separate the batch of documents 210 from a successive batch of documents.

FIGS. 5A-5D illustrate procedures of the method for job separation in a high volume document scanning, when the light sensing device 306 is used a monitor device 202, in accordance with an embodiment of the present disclosure.

Figure 5A:
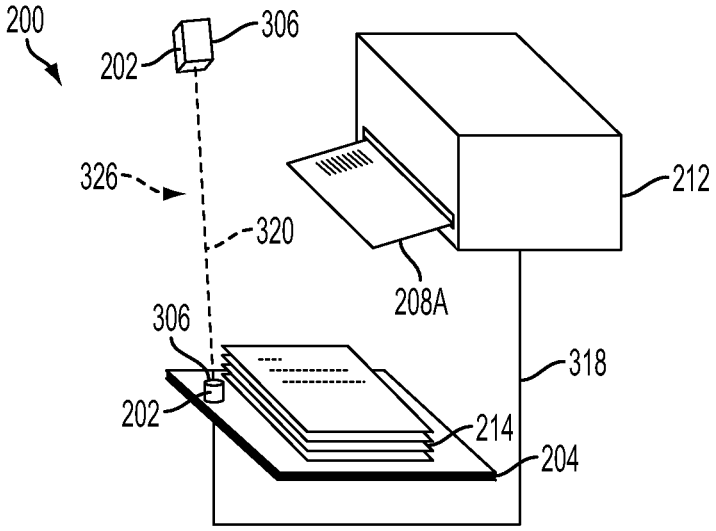
FIGS. 5A-5D illustrate procedures of the method for job separation in a high volume document scanning, when a light sensor is used as a monitor device, in accordance with an embodiment of the present disclosure.
Figure 5B:
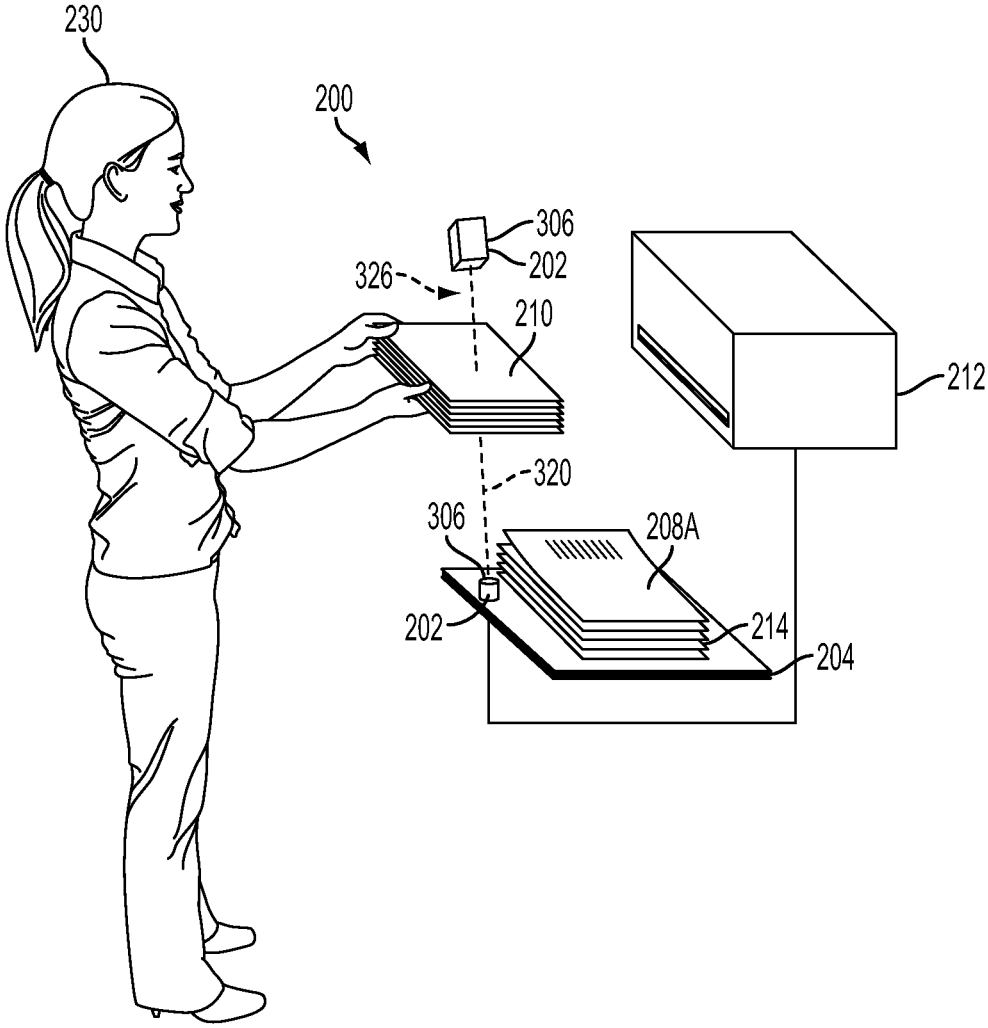

Referring to FIGS. 5A and 5B, in response to the light sensing device 306 determining that a new batch 214 of documents has been received by the document receiver 204, the separation document inserter 212 automatically inserts a job separation document 208A at an end of the batch 214 to separate the batch of documents 214 from a successive batch of documents 210.

After the job separation document 208A is inserted at an end of the batch 214, the light sensing device 306 continues to monitor the document receiver 204 to determine when a new batch 210 of documents has been received by the document receiver 204.

Figure 5C:
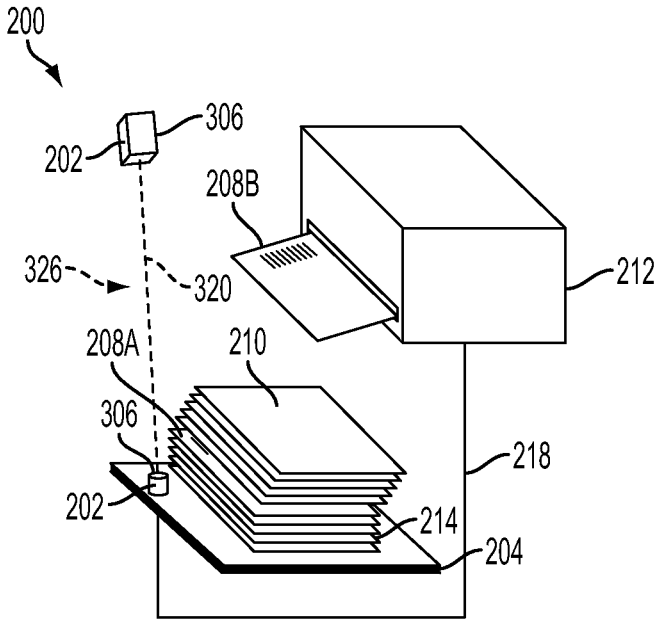
Figure 5D:
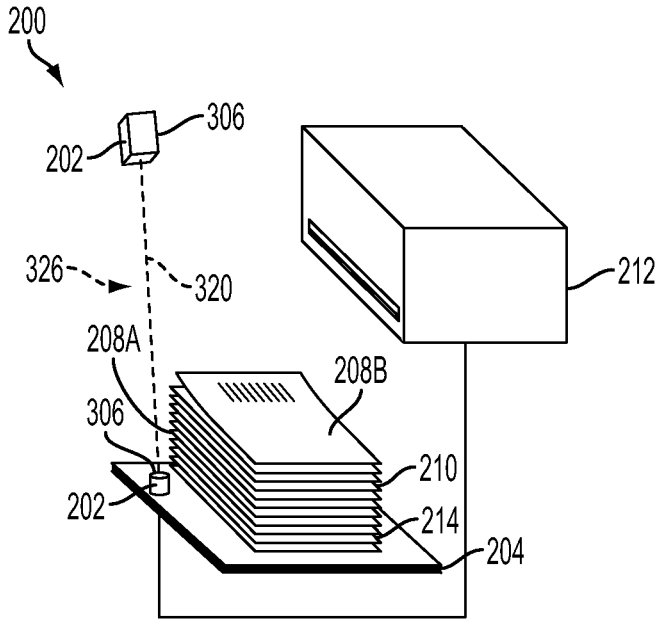

When an operator 220 adds a new batch 210 of documents to the document receiver 204, as shown in FIGS. 5B and 5C, the light sensor 306 determines that the batch 210 of documents is received by the document receiver 204 and sends a signal 318 to the separation document inserter 212. The signal 318 indicates that a new batch of documents is added to the document receiver 204. In response to the signal 318, as shown in FIGS. 5C and 5D, the separation document inserter 212 automatically inserts a job separation document 208B at an end of the batch 210 to separate the batch of documents 210 from a successive batch of documents.

Thus, the proposed system and method solves the problem of manual insertion of slip sheet(s) between document sets. As noted above, the system and the method achieves this by automatically inserting separator or slip sheets between different scan jobs, without additional user intervention. Also, as noted above, the use of slip sheets during the document scanning improves the document separation after the scanning is complete. The proposed method thus saves the process time of manual slip sheet insertion without making it difficult to separate the originals after scanning.

The term "document," as used herein, refers to a usually flimsy physical sheet of paper, such as a standard 8½×11 inch letter paper, A4 paper, or 8½×14 inch legal paper. However, it will be appreciated that "document" may include other sizes and printable media types, such as, bond paper, parchment, cloth, cardboard, plastic, transparencies, film, foil, or other print media substrates, whether precut or web fed. Any reference to paper is not to be construed as limiting. Different grade and/or gloss media or documents may be used. The term "batch of documents," as used herein, refers to a plurality of sheets. In one embodiment, for example, the "batch of documents" may include a single sheet or document or media.

In the embodiments of the present disclosure, the processor, for example, may be made in hardware, firmware, software, or various combinations thereof. The present disclosure may also be implemented as instructions stored on a machine-readable medium, which may be read and executed using one or more processors. In one embodiment, the machine-readable medium may include various mechanisms for storing and/or transmitting information in a form that may be read by a machine (e.g., a computing device). For example, a machine-readable storage medium may include read only memory, random access memory, magnetic disk storage media, optical storage media, flash memory devices, and other media for storing information, and a machine-readable transmission media may include forms of propagated signals, including carrier waves, infrared signals, digital signals, and other media for transmitting information. While firmware, software, routines, or instructions may be described in the above disclosure in terms of specific exemplary aspects and embodiments performing certain actions, it will be apparent that such descriptions are merely for the sake of convenience and that such actions in fact result from computing devices, processing devices, processors, controllers, or other devices or machines executing the firmware, software, routines, or instructions.

While the present disclosure has been described in connection with what is presently considered to be the most practical and preferred embodiment, it is to be understood that it is capable of further modifications and is not to be limited to the disclosed embodiment, and this application is intended to cover any variations, uses, equivalent arrangements or adaptations of the present disclosure following, in general, the principles of the present disclosure and including such departures from the present disclosure as come within known or customary practice in the art to which the present disclosure pertains, and as may be applied to the essential features hereinbefore set forth and followed in the spirit and scope of the appended claims.

What is claimed is:

1. A method for job separation in a high volume document scanning comprising:

monitoring a document receiver with a monitor device to determine when a batch of documents has been received by the document receiver; and in response to the monitor device determining the batch of documents has been received by the document receiver, automatically inserting a job separation document with a separation document inserter at an end of the batch to separate the batch of documents from a successive batch of documents.

2. The method according to claim 1, wherein the monitoring and the inserting procedures are repeated for each successive batch of documents.

3. The method according to claim 1, wherein the monitor device is a weighing machine configured to monitor a change in weight of the received documents to detect when a new batch of documents is added to the document receiver.

4. The method according to claim 1, wherein the monitor device is a weighing machine configured to monitor a change in weight of the document receiver to detect when a new batch of documents is added to the document receiver.

5. The method according to claim 1, wherein the monitor device is a light sensing device that includes a light beam transmitter and a light beam receiver, wherein the light beam receiver is configured to receive a light beam from the light beam transmitter and to detect a change in transmission of the light beam emitted by the light beam transmitter when a new batch of documents is passed between the light beam transmitter and the light beam receiver so as to determine when a new batch of documents is added to the document receiver.

6. The method according to claim 1, further comprising, during scanning of the received documents, separating the job separation documents from the received documents and placing the separated job separation documents into a job separation document receiver for reuse during a subsequent job separation.

7. The method according to claim 1, further comprising, during scanning of the received documents, shifting the job separation documents relative to their adjacent batches of documents as the job separation documents and their adjacent batches of documents are being placed into an output document receiver.

8. The method according to claim 7, further comprising separating the job separation documents and their adjacent batches of documents after the scanning and placing the separated job separation documents into a job separation document receiver for reuse during a subsequent job separation.

9. A system for job separation in a high volume document scanning comprising:

a monitor device configured to monitor a document receiver to determine when a batch of documents has been received by the document receiver; and a separation document inserter configured to automatically insert, in response to the monitor device determining the batch of documents has been received by the document receiver, a job separation document at an end of the batch to separate the batch of documents from a successive batch of documents.

10. The system according to claim 9, wherein the monitor device is a weighing machine configured to monitor a change in weight of the document receiver to detect when a new batch of documents is added to the document receiver.

11. The system according to claim 9, wherein the monitor device is a weighing machine configured to monitor a change in weight of the received documents to detect when a new batch of documents is added to the document receiver.

12. The system according to claim 9, wherein the monitor device is a light sensing device configured to monitor when a new batch of documents are added to the document receiver.

* * * * *